US005192009A

United States Patent [19]

Hildebrandt et al.

[11] Patent Number: 5,192,009

[45] Date of Patent: Mar. 9, 1993

[54] DEVICE FOR SPRAYING FLUIDS, HAVING ELECTRICALLY OPERATED AIR COMPRESSOR AND FREE BLOWING NOZZLE

[75] Inventors: Bodo Hildebrandt, Riedstadt; Detlef Mattinger, Bickenbach; Karl Trinkaus, Darmstadt, all of Fed. Rep. of Germany

[73] Assignee: Wella Aktiengesellschaft, Darmstadt, Fed. Rep. of Germany

[21] Appl. No.: 656,054

[22] PCT Filed: Jun. 30, 1990

[86] PCT No.: PCT/EP90/01051

§ 371 Date: Feb. 11, 1991

§ 102(e) Date: Feb. 11, 1991

[87] PCT Pub. No.: WO91/00149

PCT Pub. Date: Jan. 10, 1991

[30] Foreign Application Priority Data

Jun. 30, 1989 [DE] Fed. Rep. of Germany ..... 392143
Jun. 30, 1989 [DE] Fed. Rep. of Germany ... 8907976[U]
Jun. 30, 1989 [DE] Fed. Rep. of Germany ... 8907977[U]

[51] Int. Cl.[5] ..... B65D 83/00

[52] U.S. Cl. ..... 222/400.5; 222/401; 239/113; 239/351

[58] Field of Search ..... 222/148, 333, 400.5, 222/400.8, 401, 402.18, 630, 635; 239/112-113, 351, 366

[56] References Cited

U.S. PATENT DOCUMENTS 4,046,289 9/1977 Teranishi ..... 222/333
4,222,525 9/1980 Hildebrandt ..... 222/470
4,972,977 11/1990 Fuhrig ..... 222/401
5,046,667 9/1991 Fuhrig ..... 239/351

*Primary Examiner*—Andres Kashnikow
*Assistant Examiner*—Philippe Derakshani
*Attorney, Agent, or Firm*—Michael J. Striker

[57] ABSTRACT

A device for the spraying of fluids includes an air pump which can be driven electrically via a switch, a container for the fluid to be sprayed, and a nozzle whose air inlet opening is connected with the air pump via a compressed air duct, a valve which, together with a switch, can be actuated in such a way that, in order to initiate a spraying process, the switch is first closed and the valve then opens connections between the compressed air duct and an air space of the container the fluid conduit and the fluid inlet opening. At the conclusion of the spraying process, the fluid conduit and the connection between the compressed air duct and the interior of the container are blocked, and a connection between the compressed air duct and the fluid inlet opening is opened.

32 Claims, 7 Drawing Sheets

DEVICE FOR SPRAYING FLUIDS, HAVING ELECTRICALLY OPERATED AIR COMPRESSOR AND FREE BLOWING NOZZLE

The invention is directed for the spraying of fluids comprising an air pump which can be driven electrically via a switch, a container for the fluid to be sprayed, and a nozzle whose air inlet opening is connected with the air pump via a compressed air duct.

The known devices for the spraying of fluids comprising an air pump and a nozzle are advantageously distinguished in that no propellant gas is required. However, compared with spray cans using propellant gas, they also have disadvantages which consist in that e.g. the pressure required for a fine spraying of the fluid must first be built up at the beginning of a spraying process by means of putting the air pump into operation. In so doing, the fluid, which at first does not exit in a finely atomized state, is troublesome. Further, there is a delay between the actuation of an operating control and the issuing of a usable spray stream. This delay is particularly troublesome when several consecutive bursts of spray are required within a relatively short time period, e.g. when styling hair.

In a known electropneumatically operated spray can system (DE37 11 874 A1) it is provided that the air feed is first effected when pressing a button and the fluid feed is released to a venturi nozzle only at the end stop of the button. Due to the slight vacuum pressure, the spraying effect or atomization depends on the fluid state in the supply container and on the viscosity of the fluid.

It is the object of the present invention to provide a device of the generic type for the spraying of fluids which comprises the same characteristics with respect to application technology as an aerosol can filled with compressed gas. Moreover, the conventional form and handling, as desired, of an aerosol can filled with compressed gas is to be achieved.

This involves the following requirements:

- same spray quality (spray cone, particle size, spray stream pressure).
- immediate spraying of the device when actuated.
- uniform, constant spray stream regardless of the degree of filling of the supply container.
- immediate discontinuation of spray stream without dripping or after-spraying.
- rapid successive spray bursts are to be made possible.
- protection against leakage in all positions of the device.
- easy actuation of the spray button.
- simple refilling of the - economically producible - supply container.

Moreover, a drying up of residual fluid is prevented from leading to interferences in function (poor spraying, etc.).

This object is met, according to the invention, by providing a valve connecting the compressed air duct with the air space of the container, and comprising a control cylinder having three openings for connection with an air inlet opening and a fluid inlet opening of the nozzle and the container air space, and a piston displaceable in the cylinder.

The steps, according to the invention, ensure that fluid is only directed through the tangential ducts of the nozzle when there is a sufficiently high flow speed of air. Further, the fluid feed is effected during the entire spraying process with a substantially constant pressure.

A fine atomization accordingly occurs immediately after actuation and persists during the entire spraying process.

Due to the closing of the connection between the air space of the container and the compressed air duct, no fluid can penetrate into the air compressor even when the device is in a horizontal or inverted position. The pressure built-up in the container during a spraying process is accordingly also stored over a longer period of time, so that when a spraying process is effected subsequently or when several successive spray bursts are effected, the air required at the time by the air compressor is not needed first for building up the required pressure within the container.

According to a further development of the invention, it is provided that the valve is constructed as a multiple-way valve and that after the duct is closed, another duct is opened between the compressed air duct and the fluid inlet openings of the nozzle.

As a result of this development, the nozzle, particularly the tangential ducts, is blown free after every spraying process. Closing of the tangential ducts by dried up fluid residues is accordingly prevented, so that there can be no impairment to the functioning of the nozzle.

An advantageous construction of the device, according to the invention, consists in that the control piston is arranged so as to be axially movable in the control cylinder whose diameter is greater than the diameter of the control piston, in that the control piston is provided with two circumferentially extending sealing rings which divide the control cylinder into first, second and third chambers, in that the first and third chambers are connected with the compressed air duct, in that the second chamber located between the sealing rings is connected with the ascending pipe via a duct located in the control piston, in that the air inlet opening of the nozzle is arranged in the area of the first chamber in the outer surface area of the control cylinder, and in that the fluid inlet opening of the nozzle is further arranged in the outer surface area of the control cylinder in such a way that the fluid inlet opening is in the area of the second chamber when the valve is actuated, and in the area of the third chamber when the valve is not actuated.

According to another advantageous construction, it is provided that the control piston, which is provided with a longitudinal bore hole, is arranged inside the control cylinder so as to be axially movable and divides the control cylinder into first and a second chamber by means of a sealing ring, in that at least one opening is provided in the wall of the control piston at both sides of the sealing ring in each instance, in that at least one outlet opening is provided at each end of the control cylinder, in that a pressure spring is arranged in the second chamber, which pressure spring presses the control piston in the direction of the first chamber and in so doing closes the first outlet opening with the sealing ring, which first outlet opening is connected with the container, in that the second outlet opening is connected with the air inlet opening of the nozzle, and in that an additional valve, which is connected with the control piston, releases a fluid duct between an ascending pipe and an annular duct of the nozzle during the movement of the control piston against the pressure spring.

A further development of the invention consists in that an ascending pipe and sealing lips are provided at a head part comprising the valve and the nozzle, which ascending pipe and sealing lips penetrate the container when the head part is placed on the container. It is preferably provided that the container be sealed with a foil which is at least partially destroyed when the head part is placed on top. It is accordingly made possible in a simple manner to use disposable containers, wherein an empty container can be exchanged with a filled container in a simple manner.

Another development of the invention consists in that the container has the approximate shape of a hollow cylinder whose annular hollow space is provided for the fluid to be sprayed, space being provided in its interior for the air pump and an electric drive.

This further development enables an extremely handy device which hardly differs from a conventional spray can with respect to external form and operation. Moreover, the noise produced by the electric motor and the pump is damped to a great degree in this development.

An advantageous embodiment form of this further development provides that the air pump and an electric motor form a substantially cylindrical air compressor which is adapted in diameter to the inner diameter of the container, and that the air compressor has a battery compartment in the lower area which is adapted to the outer diameter of the container. Sufficient space is accordingly provided for batteries of sufficient capacity. Moreover, there is a low center of gravity and accordingly a good standing stability of the device. Rechargeable or other batteries can also be used in the device according to the invention. Contacts or an inductive transformer can be provided for charging.

The present invention both as to its construction so to its mode of operation, together with additional objects and advantages thereof, will be best understood from the following detailed description of the preferred embodiments when read with reference to the accompanying drawings.

DETAILED DESCRIPTION OF THE PREFERRED EMBODIMENTS

Figure 1:
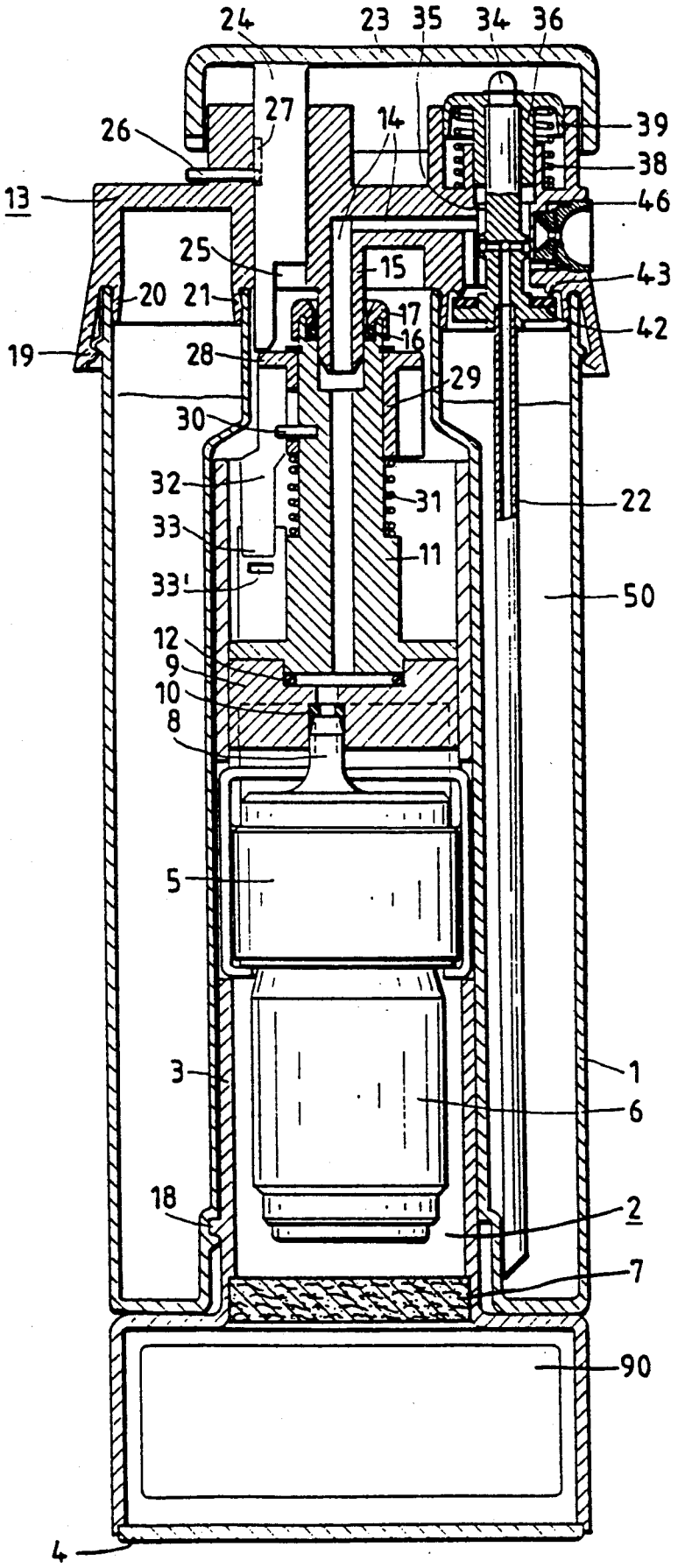
FIG. 1 shows a longitudinal cross-sectional view of a first embodiment of the device according to the invention with a supply container in the form of a hollow cylinder.
Figure 2:
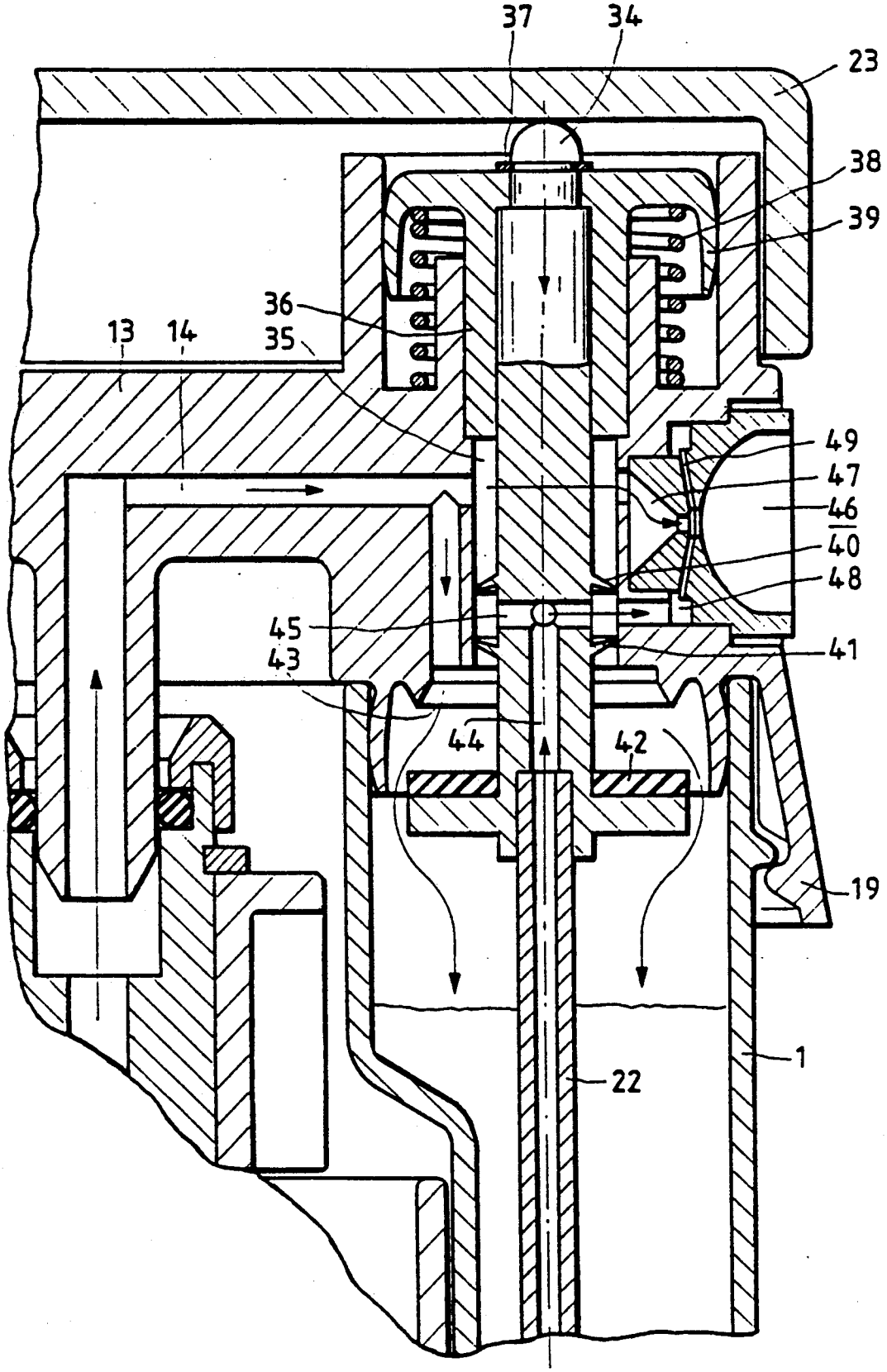
FIG. 2 shows an enlarged partial cross-sectional view of the head part and parts of the air compressor and the container of the embodiment example according to FIG. 1.

FIG. 1 shows the first embodiment in the rest position, while FIG. 2 shows the spraying position. A supply container 1 in the form of a hollow cylinder comprises an air compressor 2, whose housing 3 has a greater diameter in the lower part, serves as a compartment for possibly rechargeable batteries 90 and is closed by a base plate 4. An air pump 5 and an electric motor 6 are provided in the center part of the housing 3. The air pump 5 sucks in the air through an air filter 7 and releases the compressed air via a connection piece 8 which projects into an intermediate piece 9 and is sealed with the latter by means of a seal 10. A pneumatic adapter 11 which is connected with the intermediate piece 9 by means of a flange is provided for further guidance of the compressed air and for connection to the head part 13. An O-ring 12 serves as a seal between these two parts.

The head part 13 comprises a compressed air duct 14 which coaxially comprises a connection part 15 for the pneumatic adapter 11, which connection part 15 engages in the opening of the pneumatic adapter 11 provided for this purpose. An additional O-ring 16 is provided for sealing, which O-ring is held by a bushing 17 in the pneumatic adapter 11.

A bayonet catch, indicated at 18, is provided for fixing the container 1 at the air compressor 2. The head part 13 is fixed on the container 1 by means of a snap connection 19 and sealed by means of two circumferentially extending sealing lips 20, 21. Moreover, an ascending pipe 22 located at the head part 13 projects into the container.

The head part is provided with a push button 23 constructed so as to have a large surface area, which push button 23 is connected in one piece with a tappet 24 which is guided in a corresponding bore 25 of the head part 13. A pin 26, which engages in a groove 27 of the tappet 24, is provided as a stop limiter for the axial lift. The tappet 24 is in a working connection with an annular keying surface 28 which slides on the pneumatic adapter 11 with a sleeve-shaped part 29. A pin serves to fix the axial path against the pressure of the spring 31. The pressure spring 31, which is supported on the pneumatic adapter 11, presses the sleeve 29 and, accordingly, the keying surface 28 against the tappet 24, so that the unactuated button 23 is located at the upper end of its actuating path. If the button 23 is pressed down against the force of the spring 31, the electric switch 33 is closed via an actuating arm 32 and an actuating member 33', so that the motor 6 is supplied with current via electrical lines, not shown in detail, and operation of the pump 5 is accordingly started.

In addition to closing the switch 33, the button 23 also actuates a control piston 34 which is arranged so as to be axially movable in a control cylinder 35 of the head part 13. For this purpose, the control piston 34 is provided in the upper area with a guide sleeve 36 which is guided in the head part 13. A retaining ring 37 is provided for securing the guide part 36 on the control piston 34. Moreover, the guide part 36 comprises a flange which serves to receive the force of a pressure spring 38 and is constructed at the circumference as a sealing lip 39. The control piston is provided with two sealing rings 40, 41 which abut at the outer surface area of the control piston 34 so as to seal. The lower part of the control piston 34 is constructed in a plate-shaped manner and comprises a seal 42 which presses against a circumferentially extending sealing edge 43 in the upper position of the control piston 34. Further, the ascending pipe 22 is arranged at the lower end of the control piston, the bore of the ascending pipe 22 continues into a fluid duct 44 of the control piston 34 which, aside from an axial part, comprises at least one transverse bore 45 which is arranged between the sealing rings 40, 41.

Further, a nozzle 46, known per se, is arranged in the head part 13 and comprises an air inlet opening 47 and a fluid inlet opening 48, tangential ducts 49 proceeding from the latter in a manner which is known per se.

In the rest position, the seal 42, together with the circumferentially extending sealing edge 43, seals the container relative to the compressed air duct 14. Accordingly, on the one hand, this prevents fluid 50 from penetrating into the compressed air producer 2, also when the device is in a horizontal position. On the other hand, excess pressure remains in the container 1 after a spraying process, so that there is already pressure in the container 1 for the following spraying process.

Further, in the rest position, the upper sealing ring 40 is below the compressed air duct and the opening for the nozzle, and the lower sealing ring 41 is above the opening for the fluid inlet opening 48 of the nozzle 46. The fluid duct 44 is accordingly also sealed.

In order to initiate a spraying process, the motor 6 is first switched on by pressing the button 23, whereupon pressure is built up in the compressed air duct 14 and air already flows through the nozzle 46 when the connection between compressed air duct 14 and the container 1, on the one hand, and the connection between the ascending pipe 22 and the fluid inlet opening 48 of the nozzle 46 are released by the backward movement of the control piston 34. It is accordingly ensured that a sufficiently fine atomization of the fluid is effected immediately after the fluid feed to the nozzle.

At the conclusion of the spraying process, the fluid duct 44 and the connection between the compressed air duct 14 and the interior of the container 1 are first closed. Compressed air is still blown through the nozzle 46 for a period of time thereafter, but no more new fluid is supplied. The compressed air flows from the compressed air duct 14 through the air inlet opening 47 on the one hand and through the control cylinder 35, fluid inlet opening 48 and tangential ducts 49 on the other hand. Fluid residues are accordingly blown out of the nozzle, so that it remains free of dried-in residues of fluid. Finally, the motor 6 is switched off.

Figure 3:
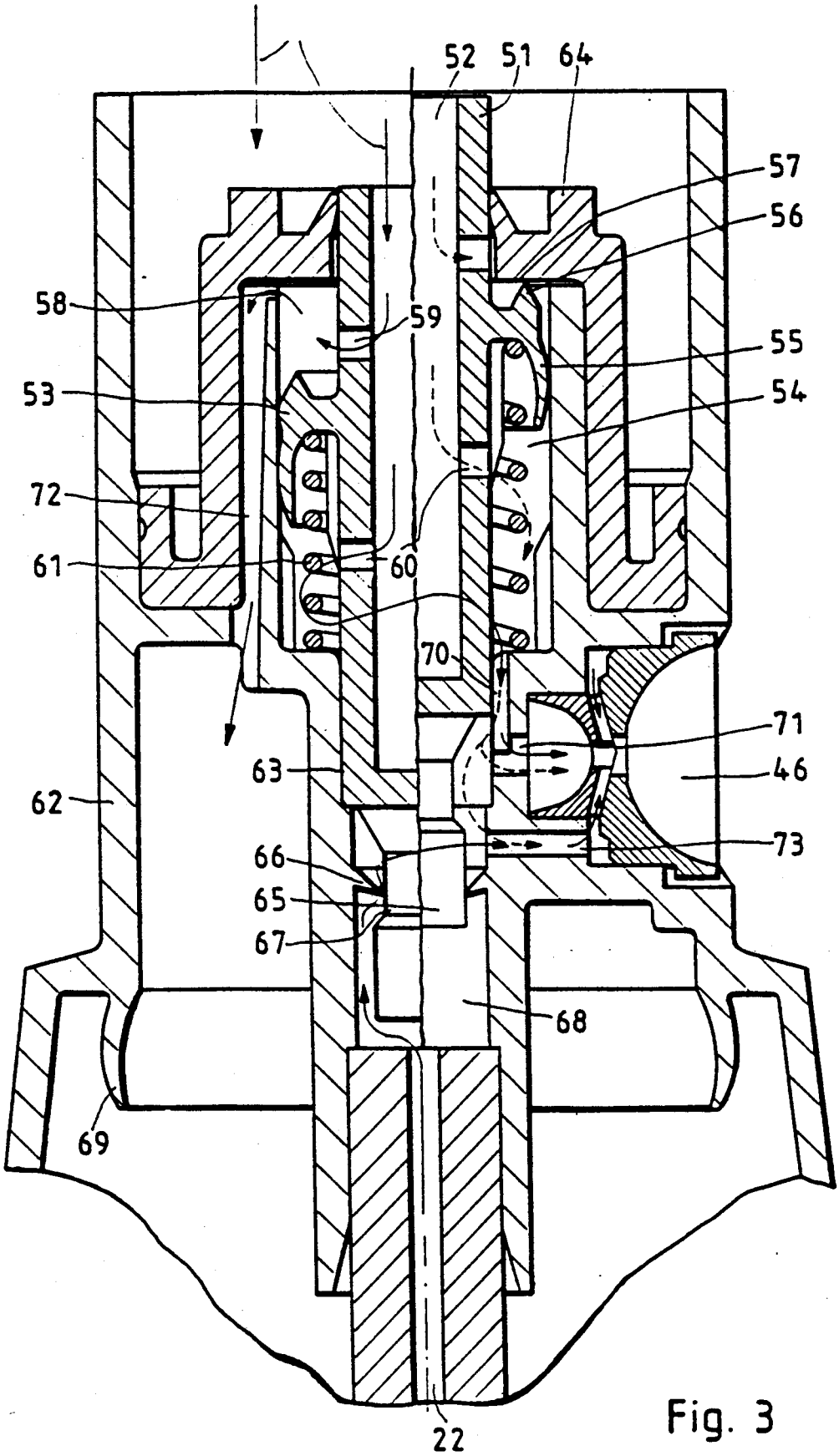
FIG. 3 shows a partial longitudinal cross-sectional view of a second embodiment of the device according to the invention.

In the embodiment according to FIG. 3, the control piston 51 comprises an axially extending hollow space 52 in which air is fed from the compressed air compressor in a manner which is not shown in more detail. The control piston 51 is shown in the spraying position at left and in the rest position at right. The control piston 51 comprises a sealing ring 53 which slides at the inner surface of a control cylinder 54 with a sealing lip 55. Moreover, a circumferentially extending sealing edge 56 is provided at the sealing ring and sits on the upper end face 57 of the cylindrical hollow space 54 in the upper position of the control piston 51 and accordingly blocks a first outlet opening 58. A plurality of openings 59, 60 are provided both above and below the sealing ring 53 in the wall of the control piston 51. A pressure spring 61 presses the control piston upward.

The head part 62 shown in FIG. 3 serves at 63 as a lower guide for the control piston 51, while a guide is provided in the upper area of the control piston in a guide part 64 inserted in the head part 62.

The lower part 65 of the control piston passes through an annular seal 66 whose diameter is large enough that the lower part 65 of the control piston is sealed relative to the ascending pipe 22. However, a portion 67 of the control piston provided above the lower part 65 has a smaller diameter than the opening in the annular seal 66, so that the fluid duct 68 is released in the lower position of the control piston 51. An annular sealing lip 69 serves to seal relative to a container, not shown.

In a manner similar to that described above, in order to initiate a spraying process, the air compressor is first switched on, so that the compressed air flows through the interior 52 of the control piston 51, through the openings 59, 60 in the control piston 51, through the control cylinder 54 and through a second outlet opening 70 to the air inlet opening 71 of the nozzle 46. The subsequent downward movement of the control piston 51 releases the first outlet opening 58, so that the compressed air arrives in the container through an air duct 72. Fluid accordingly climbs through the ascending pipe 22 and through the fluid duct 68 which is sealed in the meantime relative to the air inlet opening 71 of the nozzle 46 by means of the control piston 51 and is opened for the fluid. The latter is effected in that the annular seal 66 now lies opposite the portion 67 with the smaller diameter. The fluid then enters into the annular duct 73 and is sprayed with the aid of the nozzle 46 by means of compressed air.

At the conclusion of the spraying process, the control piston 51 is relieved of the actuating force, so that it is moved upward by means of the action of the pressure spring 61. The fluid duct 68 is closed by means of the lower portion 65 and the annular seal 66. The control piston 51 then opens the connection between the air inlet opening 71 and the annular duct 73 of the nozzle 46, so that the entire nozzle, including the annular duct 73, is blown free. When the control piston 51 reaches the upper position, the first outlet opening 58 is finally closed by means of the sealing edge 56, so that the container is sealed relative to the compressed air duct 68, so that an air excess pressure is maintained in the container and the ascending pipe 22 is kept full of fluid under air pressure; an immediate spraying is accordingly achieved in the next spraying process. The motor 6 is then switched off.

Figure 4:
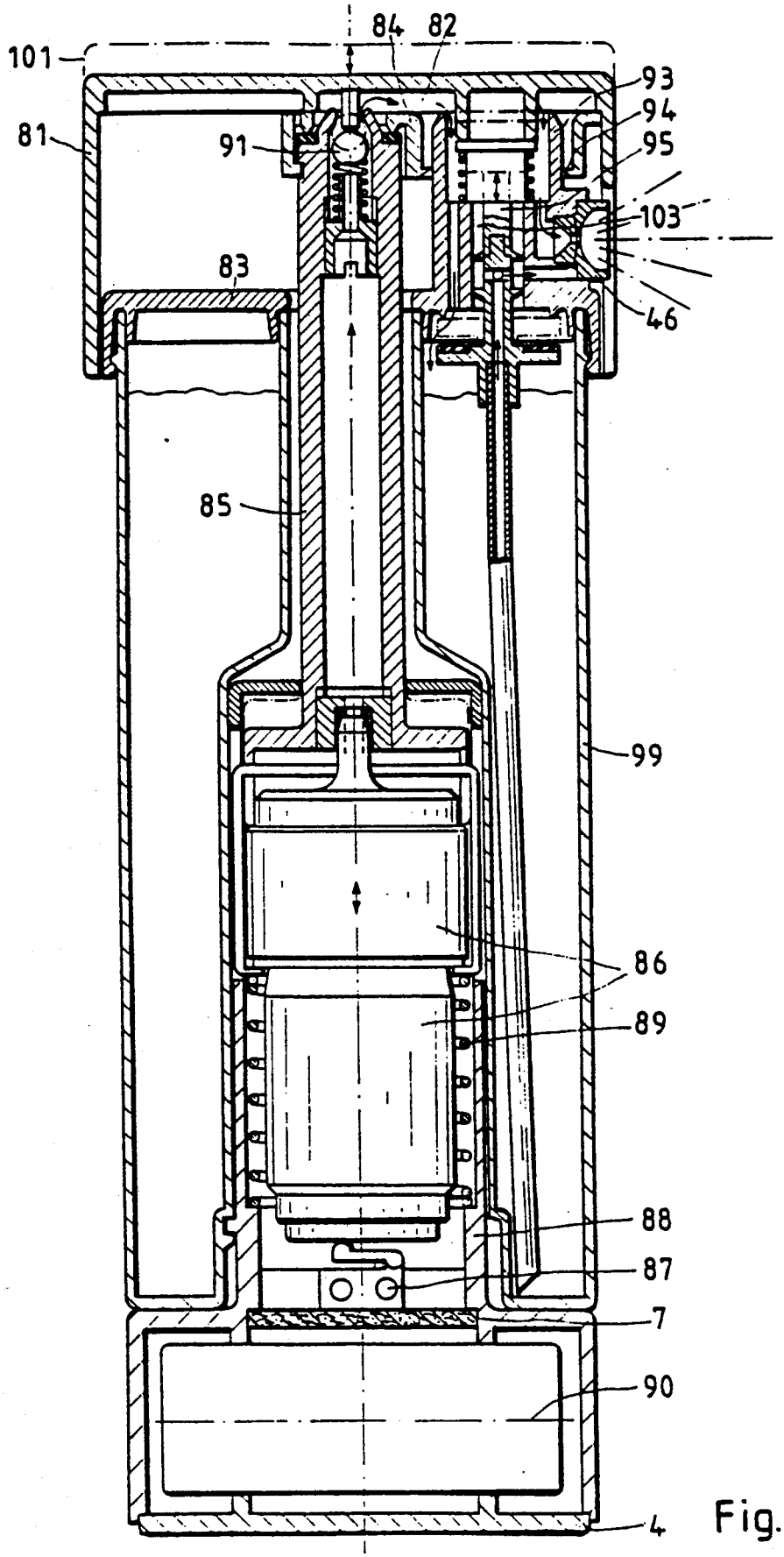
FIG. 4 shows a longitudinal cross-sectional view of a third embodiment of the device according to the invention.
Figure 5:
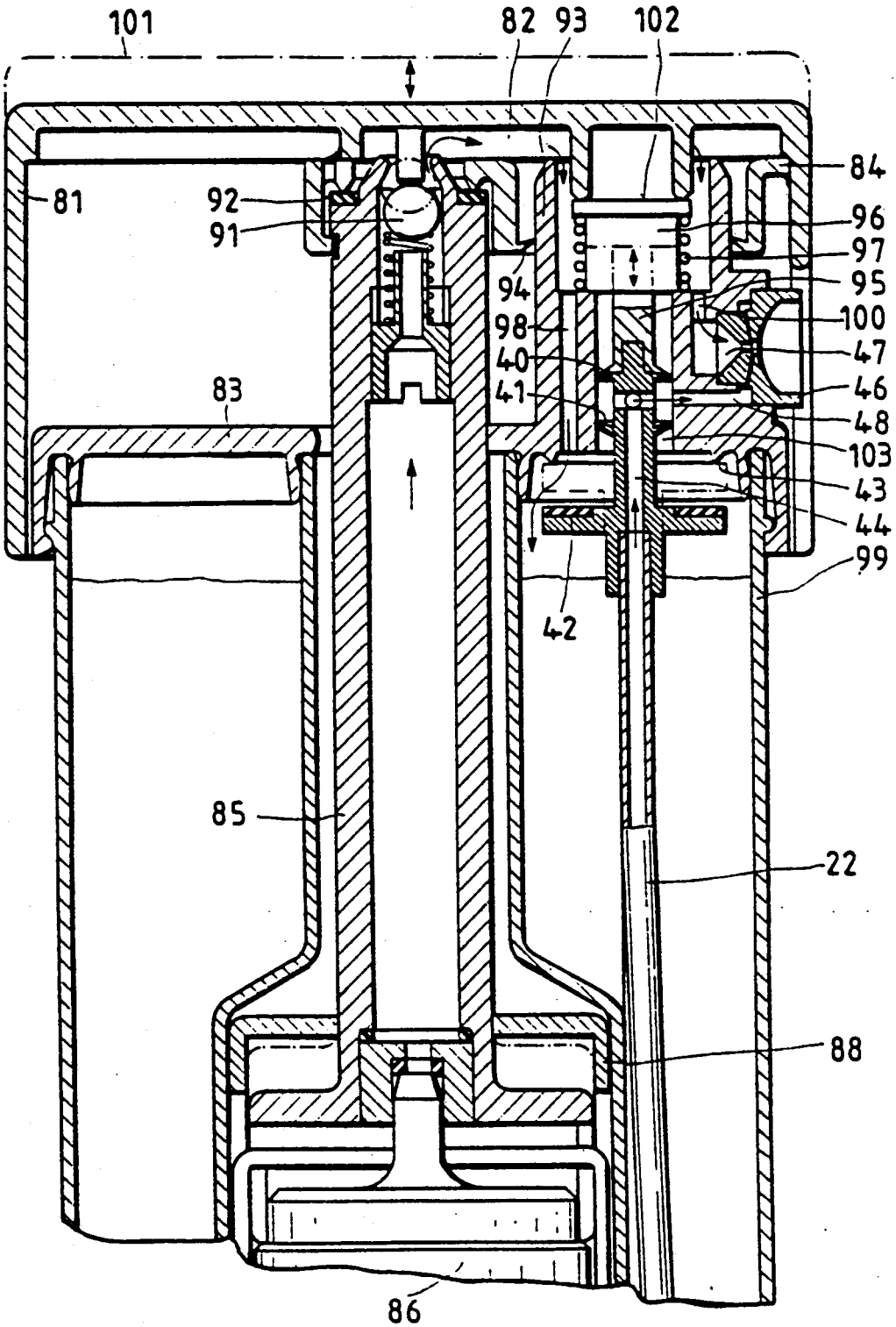
FIG. 5 shows an enlarged partial cross-sectional view of the head part and some adjoining parts of the embodiment according to FIG. 4.

In the embodiment shown in FIGS. 4 and 5, the actuating cap 81 contains a part of the compressed air duct in the form of an air guide chamber 82. The actuating cap 81 is connected with the head part 83 so as to be detachable. The air guide chamber 82 is sealed by means of a welded in cover 84.

A switch 87 is closed by means of pressure on the actuating cap 81 in the axial direction via an air guide tube 85 and a motor/pump arrangement 86. The motor/pump arrangement 86 is supported so as to be axially movable inside a cylindrical housing 88 and is pretensioned via a spring 89. The movement direction of the motor/pump arrangement 86 is indicated by a double arrow. In a manner similar to that in the embodiment example according to FIG. 1, a rechargeable battery 90 is arranged in the expanded lower part of the housing 88.

A return valve 91 at the upper end of the air guide tube 85 serves to close the air guide tube 85 when no pressure is exerted on the actuating cap 81. This prevents fluid from penetrating into the pump during refilling when the actuating cap 81 and head part 83 are removed.

A sealing ring 92 is arranged between the welded in cover 84 and the air guide tube 85 in order to seal the air guide chamber 82, while the opening of the cover 84, through which a cylindrical continuation 93 of the head part 83 passes, is movably sealed by a sealing lip 94.

In the embodiment shown in FIGS. 4 and 5, the control piston 95 is constructed similar to the control piston 34 of the first embodiment example and is movable in the control cylinder 103. However, it is provided in one piece with a receiving part 96 for the pressure spring 97. Since the diameter of the receiving part 96 is greater than the diameter of the control cylinder 103, the control piston 95 comprises two parts in a suitable manner in order to enable assembly. A coaxial bore hole 98 in the head part 83 serves as a compressed air duct for the air space of the supply container 99 and for the lower part of the control cylinder 103, while a second coaxial bore hole 100 produces the connection to the air inlet opening 47 of the nozzle 46.

In the rest state, the actuating cap 81 is located in the position indicated with a dash-dot line 101. In a corresponding manner, the sealing rings 40, 41 of the control piston 95 are located above the fluid inlet opening 48 of the nozzle 46. Moreover, the seal 42 is pressed against the circumferentially extending sealing edge 43 by means of the pressure spring 97. The container 99 is accordingly completely closed.

In order to initiate a spraying process, the actuating cap 81 is moved in the direction of the position shown in the drawing by means of a corresponding axial pressure. The switch 87 is accordingly first closed, so that the motor/pump arrangement 86 is put into operation. The air pressure required for spraying is built up within a short period of time in the hollow spaces formed by the air guide tube 85, the air guide chamber 82 and the compressed air ducts in the head part 83.

The connection between the compressed air duct 98 and the air space of the container 99 is opened on the way of the actuating cap 81 toward the position shown in the drawing, so that a corresponding pressure is exerted on the surface of the fluid, in the event that a corresponding pressure is not yet present from the preceding spraying process. At the same time, the connection is produced between the fluid duct 44 and the fluid inlet opening 48 of the nozzle 46. The fluid, which accordingly rises, is sprayed by the air flow which is then already present.

At the conclusion of the spraying process, the axial pressure is received by the actuating cap 81, whereupon the fluid duct 44 is closed by means of the sealing rings 40, 41 which slide upward. Moreover, the connection between the compressed air duct 98 and the air space of the container 99 is interrupted by the seal 42, and the connection between the compressed air duct 98 and the fluid inlet opening 48 is opened via the lower part of the control cylinder 103. The fluid inlet opening 48 and the tangential ducts of the nozzle 46 are accordingly blown through. Finally, the switch 87 is opened and the motor/pump arrangement 86 is stopped.

The embodiment according to FIGS. 4 and 5 has the advantage that the head part is relatively simple to produce, with respect to tool technology, by providing bores which extend substantially only axially. The container 99 can be expanded inward in the upper area due to the air guide tube 85 which is narrow in comparison to the motor/pump arrangement 86, so that a greater filling volume is available.

In the device, according to the invention, the container 99 can be constructed as a disposable or refillable container, depending on the requirements in the particular case. In a corresponding manner, the connection between the container 99, respectively, 1 (FIGS. 1 and 2) and the head part 83, respectively, 13 can be constructed as a snap lock or, so as to be detachable, as a thread or bayonet catch as shown in the drawings.

Thus, e.g. a packaging unit consisting of the container 99 and the head part 83 is tight without additional transport protection. An unwanted actuation is practically ruled out in that the actuating surface 102 of the valve is lower than the edge of the continuation 93 of the head part 83. Compared with a refillable container provided with a detachable connection to the head part 83, such a packaging unit is costlier but has the advantage that new fluid cannot exit when the empty packaging unit is exchanged for a new one.

Whereas in the construction as refillable container, the head part 83 is removed from the latter and, e.g., fluid residues can drip from the ascending pipe 22. A packaging unit comprising the head part and the container can be exchanged as follows: First the actuating cap 81 is taken off and the empty packaging unit is removed. The new packaging unit is then slid over the air guide tube 85 and the housing 88 and locked by means of turning. Finally, the actuating cap 81 is replaced.

Figure 6:
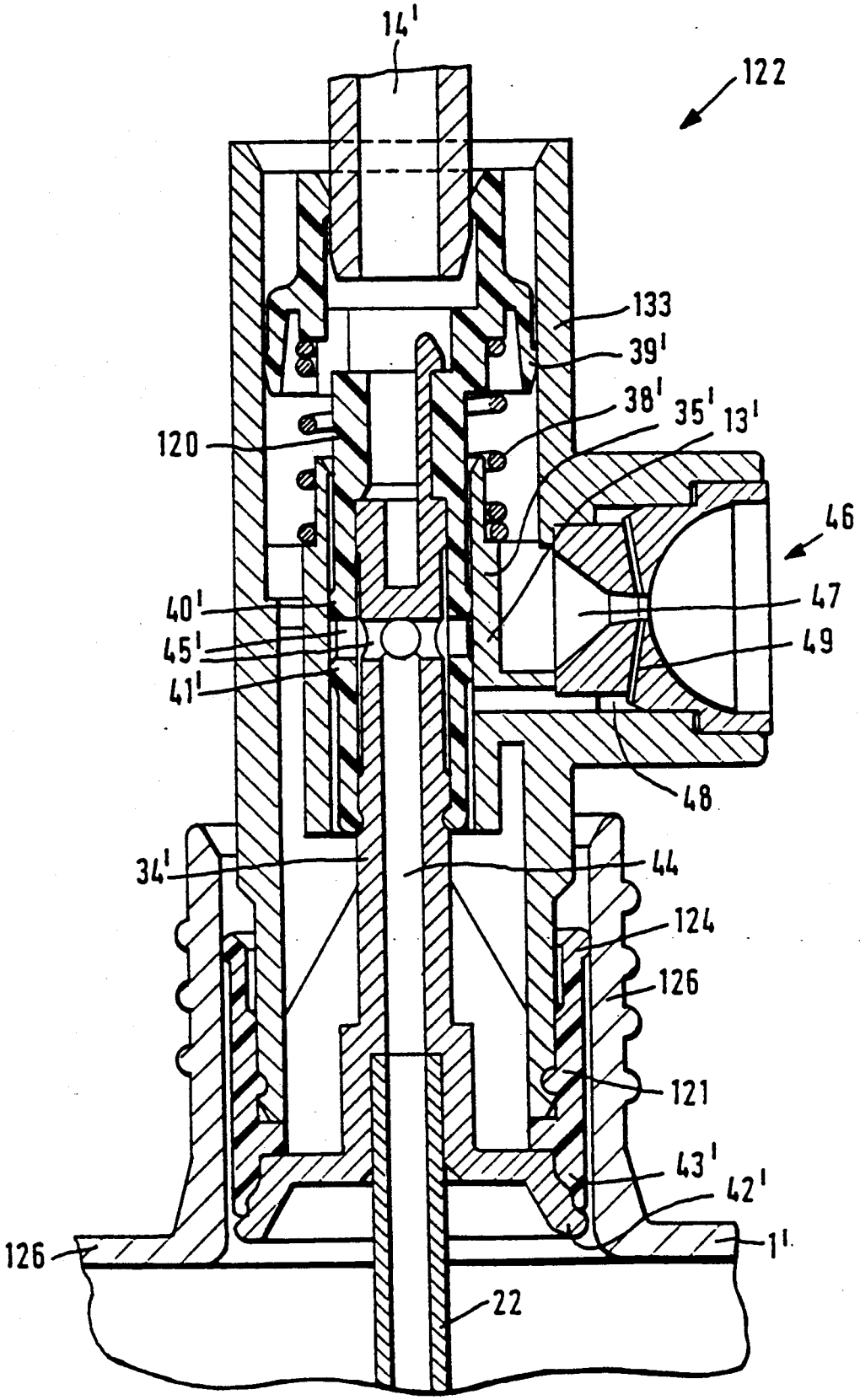
FIG. 6 shows a cross-sectional view of a control piston/nozzle constructional unit.

FIG. 6 shows a sectional view of a constructional unit 122 in which the control cylinder 13', the nozzle 46, the pressure spring 38' and the control piston 34' are designed, with the seals, as a constructional unit 122. The nozzle 46 is arranged laterally at the control cylinder 13' or at the outer cylinder 133 of the constructional unit 122, so that a very small constructional unit 122 can be realized. The sealing lip ring 39' and the sealing rings 40', 41' are constructed as a one-piece sleeve 120 and consist of softer plastic than the control piston 34' connected with the sleeve 121. The sleeve 121 connected with the control piston 34' is constructed in one piece as a sealing seat 43' and as a guiding and sealing ring 124, wherein the sealing seat (valve seat) 43' corresponds with the seal (valve disk) 42' in such a way that the seal 42' is lifted from the sealing seat 43' when the control piston 34' presses down. The sleeves 120, 121 are advantageously connected with the control piston 34' so as to lock. The constructional unit 122 can be produced economically and can be exchanged easily for a defective constructional unit 122. For the rest, the description of the functioning of the embodiment according to FIG. 2 is referred to.

Figure 7:
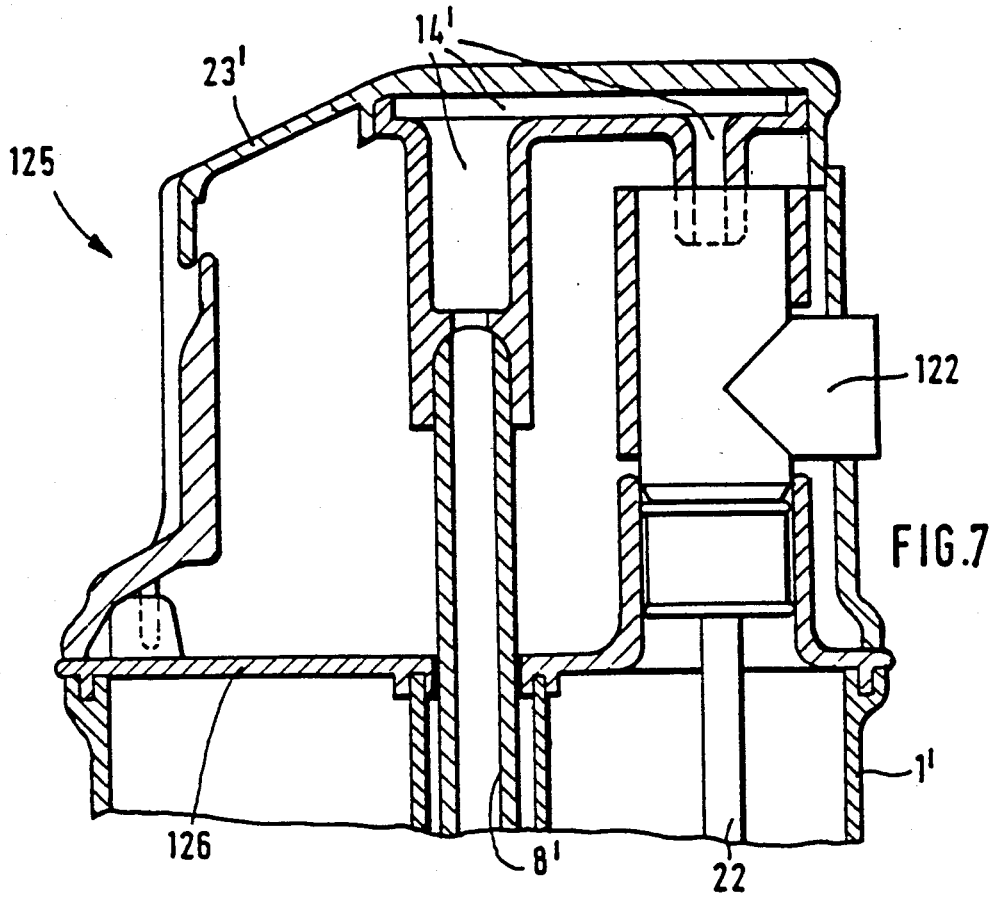
FIG. 7 shows a partial longitudinal cross-sectional view of a fourth embodiment of the device of the invention.

A fourth embodiment of a device is shown in FIG. 7, wherein the push button 23' is provided with a compressed air duct 14' which connects the compressed air connection piece 8' with the upper end of the control piston 34' when the button 23' is placed on the device. The pressure button 23' is integrated in a cap 125. The supply container 1' is provided in this instance, at the upper end, with a closing plate 126 and with an asymmetrical threaded neck 126 which receives the constructional unit 122 internally. The filled supply container 1' can accordingly be stored separately with a closing cap, not shown.

Figure 8:
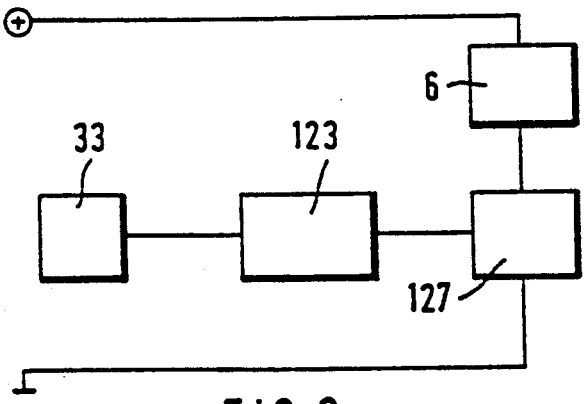
FIG. 8 shows a switch-off delay block wiring diagram.

A basic block wiring diagram for a delayed switching off of the motor 6 is shown in FIG. 8. The switch-off delay 123 is controlled by the switch 33 which controls a power switch 127 for controlling the motor 6. After a predetermined switch-off delay period, the motor 6 is switched off by the power switch 127. This after-running of the motor 6 ensures that the nozzle is blown free sufficiently and does not depend on the individual handling of the actuating button 14'.

Figure 9:
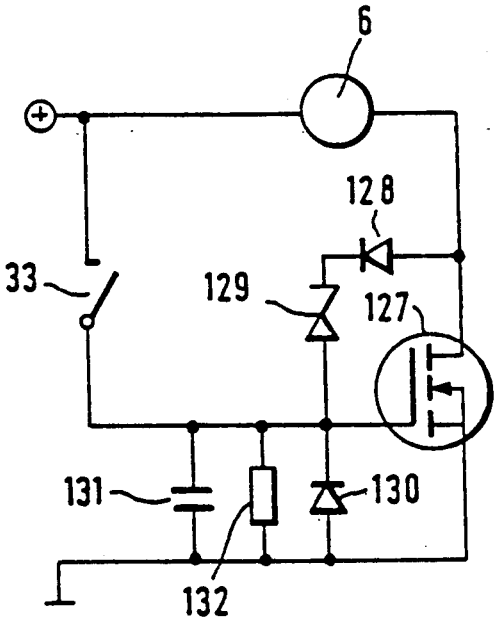
FIG. 9 shows an example of wiring for the switch-off delay.

A wiring diagram of a switch-off delay 123 is shown in FIG. 9. A MOSFET, e.g. type BUK 55350 A, is provided as a power switch 127. The diodes 128, 129 and 130 serve as a circuit to protect the MOSFET against voltage peaks from the motor 6. A capacitor 131 and a resistor 132 are provided as time-determining element. The switch-off delay functions in such a way that the power switch 127 conducts immediately when the switch 33 is turned on and accordingly switches on the motor 6 and, when the switch 33 is turned off, switches off the power switch 127 and accordingly the motor 6 after a delay via the time element 131, 132.

While the invention has been illustrated and described as embodied in a device for spraying of fluids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for spraying of fluids, comprising an electrically driven air pump; a switch for actuating said air pump; a container for a fluid to be sprayed; a nozzle having inlet air and fluid openings; a compressed air duct communicating the inlet air opening with said air pump; a fluid conduit communicating the inlet fluid opening with an interior of said container; a valve having a control cylinder including a first opening which is in communication with said inlet air opening of said nozzle, a second opening which is in communication with said inlet fluid opening of said nozzle, and a third opening which is in communication with an air space of said container, and a control piston axially displaceable in said control cylinder for controlling flow through said first and second openings and having at least one circumferential sealing ring engaging an inner wall of said control cylinder, said air pump being actuated in response to actuation of said switch to provide for air flow from said compressed air duct into the interior of said container and for fluid flow into said inlet fluid opening of said nozzle said valve deactivating said switch after communication between said compressed air duct and the interior of said container and between said fluid conduit and said inlet fluid opening is blocked by said valve at an end of a spraying process.

2. A device as set forth in claim 1, wherein said control piston has two spaced circumferential sealing rings dividing said control cylinder into first, second and third chambers, said first and third chamber communicating with said compressed air duct, the second chamber being defined by a space between said two circumferential sealing rings and communicating with said fluid conduit, said inlet air opening of said nozzle communicating with said first chamber, and said inlet fluid opening being arranged in such a manner that it communicates with said second chamber in an actuated position of said valve and communicates with said third chamber in a rest position of said valve.

3. A device as set forth in claim 2, wherein said third chamber faces said container, said control piston having a sealing flange for separating the interior of said container from said third chamber in the rest position of said valve.

4. A device as set forth in claim 3, wherein said control cylinder has an expanded area, said valve further including a sleeve remote from said container for supporting said control piston, said sleeve being axially movable in said expanded area of said control cylinder and having a flange; and a pressure spring supported against said flange.

5. A device as set forth in claim 4, wherein said flange has a sealing lip on a circumference thereof for sealing said control cylinder and an annular space in which said spring is located, against outside air.

6. A device as set forth in claim 1, wherein said control piston has a longitudinal bore, said at least one sealing ring dividing said control cylinder into a first chamber remote from said container and a second chamber adjacent to said container, said control piston having at least one opening in a wall thereof on each side from said sealing ring, said control cylinder having a first end and a first outlet opening at said first end for communicating said first chamber with said inlet air opening of said nozzle, and a second end and a second outlet opening at said second end for communicating said second chamber with the interior of said container, said valve further including a spring located in said second chamber and biasing said piston in a direction away from said container for closing said first outlet opening with said sealing ring, and an additional valve connected with said control piston for controlling fluid flow from said fluid conduit to said inlet fluid opening of said nozzle during displacement of said control piston against bias of said pressure spring.

7. A device as set forth in claim 6, wherein said additional valve comprises a piston coaxial with said control piston and having two portions of different diameters, said control cylinder having an annular seal engaging said piston.

8. A device as set forth in claim 7, wherein said sealing ring comprises a sealing lip for engaging an inner surface of said control cylinder and an annular sealing edge for engaging an end surface of said control cylinder that is adjacent to said first chamber.

9. A device as set forth in claim 1, further comprising a head part in which said valve and said nozzle are located, said head part having sealing lip means extending into said container.

10. A device as set forth in claim 9, wherein said head part is detachably attached to said container.

11. A device as set forth in claim 10, comprising a snap lock for attaching said head part to said container.

12. A device as set forth in claim 1, wherein said container comprises a hollow cylinder defining the container interior, the container interior having a space for receiving said air pump and an electric motor for driving said air pump.

13. A device as set forth in claim 12, wherein said air pump and said electric motor form a substantially cylindrical air compressor, said container having at an end thereof remote from said nozzle a compartment for receiving a battery for supplying electric power to said electric motor.

14. A device as set forth in claim 13, further comprising a head part for supporting said nozzle, said valve, and said fluid conduit, said head part including two projecting concentric sealing lips for engaging an inner wall of said container, and said head part being attachable to said air compressor.

15. A device as set forth in claim 13, further comprising a bayonet catch for attaching said air compressor to said container.

16. A device as set forth in claim 1, wherein said switch is located in said air compressor, said device comprising an operating element for actuating said switch.

17. A device as set forth in claim 1, wherein said air pump, said switch and an electric motor for driving said air pump form an air compressor, said container including a substantially cylindrical housing for receiving said air compressor and a compartment for storing a battery that provides electric power to said electric motor, an annular space between a wall of said container and said cylindrical housing defining a storage space for the fluid to be sprayed, said device further comprising a head part that closes said container and houses said valve, said head part having different ducts for delivering compressed air and fluid to said inlet air and fluid openings, respectively.

18. A device as set forth in claim 17, further comprising an operating element for actuating said switch and said valve and supported in said head part.

19. A device as set forth in claim 18, wherein said air compressor has an air outlet opening, said operating element comprising a cap having an air guide chamber, communicating with air ducts in said head part, said device further comprising an air guide tube communicating said air outlet opening with said air guide chamber.

20. A device as set forth in claim 19, further comprising a spring for axial displacing said air guide tube which is operationally connected with said switch, said operating element including means for transmitting pressure applied to said operating element, to said air guide tube and said control piston.

21. A device as set forth in claim 20, wherein said air pump and said electric motor are movable together with said air guide tube, said switch being located in a space between said motor and said battery storing compartment and being actuated in response to a respective movement of said air guide tube.

22. A device as set forth in claim 17, wherein said container compartment has a portion having a diameter greater than a diameter of said cylindrical housing, and the battery is arranged in said container compartment.

23. A device as set forth in claim 22, wherein said greater diameter portion is located beneath a casing of said container, said cylindrical housing being defined by an inner wall of said container spaced from an outer wall thereof.

24. A device as set forth in claim 19, wherein said air guide tube includes a spring-loaded valve, said operating element having a pin for actuating said spring-loaded valve.

25. A device as set forth in claim 19, wherein said head part comprises axial openings for receiving said air guide tube and said control cylinder, said axial openings and said air ducts being arranged concentrically relative to each other.

26. A device for spraying fluids, comprising an electrically driven air pump; a switch for actuating said air pump; container for a fluid to be sprayed; a nozzle having inlet air and fluid openings; a compressed air duct communicating the inlet air opening with said air pump; a fluid conduit communicating the inlet fluid opening with an interior of said container; and a valve for controlling flow through said inlet air and fluid openings, said valve having a rest position in which it connects the inlet fluid opening with said compressed air duct and blocks fluid flow from said fluid conduit to said fluid inlet opening, and an actuating position in which it blocks communication between said inlet fluid opening and said compressed air duct and opens communication between said compressed air duct and the interior of the container and between said fluid conduit and said inlet fluid opening.

27. A device as set forth in claim 2, further comprising a sleeve mounted on said control piston and defining said sealing rings, said control piston being formed of a plastic material, and said sleeve being formed of another plastic material softer than said plastic material of said piston.

28. A device as set forth in claim 1, wherein said nozzle and said valve together with associated ducts and seals form a sub-assembly, said device further comprising a plastic sleeve arranged in said container for receiving said sub-assembly and formed of a plastic material which is softer than a plastic material said control piston is formed of.

29. A device as set forth in claim 9, wherein said head part is formed as a separate sub-assembly.

30. A device as set forth in claim 19, wherein said air guide chamber communicates with an upper end of said control piston.

31. A device as set forth in claim 1, further comprising an electric motor for driving said air pump and having switch-off delay means.

32. A device as set forth in claim 31, wherein said switch-off delay means has a switch-off delay time of approximately 0.5 sec.

* * * * *